US010622175B2

(12) United States Patent
Kowalik et al.

(10) Patent No.: US 10,622,175 B2
(45) Date of Patent: Apr. 14, 2020

(54) IN-LINE MOTORIZED DOUBLE BREAK DISCONNECT SWITCH

(71) Applicant: CLEAVELAND/PRICE INC., Trafford, PA (US)

(72) Inventors: Peter M. Kowalik, Trafford, PA (US); James R. Shychuck, Greensburg, PA (US)

(73) Assignee: CLEAVELAND/PRICE INC., Trafford, PA (US)

( * ) Notice: Subject to any disclaimer, the term of this patent is extended or adjusted under 35 U.S.C. 154(b) by 0 days.

(21) Appl. No.: 16/271,795

(22) Filed: Feb. 9, 2019

(65) Prior Publication Data

US 2020/0006022 A1 Jan. 2, 2020

Related U.S. Application Data

(60) Provisional application No. 62/692,932, filed on Jul. 2, 2018.

(51) Int. Cl.
*H01H 33/02* (2006.01)
*H01H 33/12* (2006.01)
(Continued)

(52) U.S. Cl.
CPC ..... *H01H 33/28* (2013.01); *H01H 33/022* (2013.01); *H01H 33/126* (2013.01);
(Continued)

(58) Field of Classification Search
CPC .... H01H 33/28; H01H 33/022; H01H 33/126; H01H 33/14; H01H 33/40; H01H 33/42;
(Continued)

(56) References Cited

U.S. PATENT DOCUMENTS 3,705,279 A * 12/1972 Kerr, Jr. ..... H01H 31/20 200/48 SB
4,112,268 A * 9/1978 Chung ..... H01H 31/20 200/48 SB (Continued)

OTHER PUBLICATIONS

Cleaveland/Price Inc. Bulletin DB-1021B11, entitled "Type ILO-C Hookstick Operated In-Line Transmission Switch 69 kV-230 kV 1200 A.", 4 pages.

*Primary Examiner* — William A Bolton
(74) *Attorney, Agent, or Firm* — Ronald S. Lombard

(57) ABSTRACT

A high voltage motor operated in-line double break disconnect switch suspended by an electric power line conductor wherein the switch includes a horizontally rotating switch blade, that is suspended by a motor output shaft attached to the midpoint of a blade of the switch blade to balance the blade. A communication system for controlling the motor including a switch mounted radio which may be controlled by another radio located at a distance and powered by a solar charged battery or alternatively controlled by a hand-held controller. The motorized in-line double break disconnect switch may also be arranged in a three phase installation in a two-way or three-way switching arrangement attached to a utility pole or other structure. The communication system controlled motorized in line double break disconnect switch may in addition be arranged in a phase over phase switching arrangement supported by a utility pole or other structure.

32 Claims, 13 Drawing Sheets

(51) Int. Cl.

| | |
|---|---|
| ***H01H 33/14*** | (2006.01) |
| ***H01H 33/20*** | (2006.01) |
| ***H01H 33/28*** | (2006.01) |
| ***H01H 33/42*** | (2006.01) |
| ***H01H 33/65*** | (2009.01) |
| ***H01H 33/666*** | (2006.01) |

(52) U.S. Cl.
CPC ..... *H01H 33/14* (2013.01); *H01H 33/20* (2013.01); *H01H 33/42* (2013.01); *H01H 33/62* (2013.01); *H01H 33/6661* (2013.01)

(58) Field of Classification Search
CPC .... H01H 33/62; H01H 33/6661; H01H 31/04; H01H 31/026; H01H 31/00; H01H 2031/286; H01H 3/26
USPC ..... 218/3, 2, 4–7, 14, 18; 200/48 CB, 48 P, 200/48 KB, 48 V, 48 SB, 50.39, 17 R
See application file for complete search history.

(56) References Cited

U.S. PATENT DOCUMENTS

| | | | | |
|---|---|---|---|---|
| 4,492,835 | A | 1/1985 | Turner | |
| 5,293,012 | A * | 3/1994 | Levi | H01H 31/28 200/275 |
| 5,560,474 | A * | 10/1996 | Thomas | H01H 31/00 200/48 A |
| 7,026,558 | B1 * | 4/2006 | Andreyo | H01H 3/227 200/17 R |
| 7,078,642 | B2 * | 7/2006 | Kowalik | H01H 33/124 218/14 |
| 9,355,797 | B1 | 5/2016 | Cleaveland et al. | |
| 9,881,755 | B1 | 1/2018 | Cleaveland | |
| 9,966,207 | B1 | 5/2018 | Cleaveland | |

* cited by examiner

IN-LINE MOTORIZED DOUBLE BREAK DISCONNECT SWITCH

CROSS-REFERENCE TO RELATED APPLICATION

This is application claims the benefit of U.S. Provisional Application No. 62/692,932 filed Jul. 2, 2018, which is incorporated herein by reference in its entirety.

BACKGROUND OF THE INVENTION

The present invention relates generally to an air break disconnect switch for high voltage electrical applications and, more particularly, to an in-line high voltage air break disconnect switch that mounts in-line with the transmission line conductor without the need of a group operated switch with associated ground supported mounting structure. Such an in-line high voltage disconnect switch hangs from and is supported by its associated transmission line.

One example of such an in-line high voltage disconnect switch is a vertical break disconnect switch currently manufactured and sold by Cleaveland/Price Inc., of Trafford, Pa., the present Assignee, as a type ILO-C, Hookstick Operated In-Line Transmission Switch. The switch is described in Cleaveland/Price Bulletin DB-1021611, entitled "Type ILO-C Hookstick Operated In-Line Transmission Switch 69 kV-230 kV 1200 A.". The switch is rated 69 kV-230 kV, 1200 amperes. The Cleaveland/Price Inc. type ILO-C In-Line high voltage disconnect switch utilizes a manually operated hookstick for engaging an operating eye ring attached to the breakjaw end of the switch blade of the switch. The hookstick when engaged with the operating ring imparts rotation to the hinge end of the switch blade for opening and closing of the switch. The Cleaveland/Price Inc. type ILO-C In-Line high voltage disconnect switch is a single phase switch and is versatile and can serve many functions on a three phase system. The switch can be used to sectionalize long transmission lines, disconnect lines from substations, serve as a line tap switch, and serve as a temporary maintenance switch, for example. The Cleaveland/Price Inc. type ILO-C In-Line high voltage disconnect switch saves significant installation costs compared to a non-in-line switch installed via direct ground support mounting structure. The Cleaveland/Price Inc. type ILO-C high voltage disconnect switch allows for easy, cost efficient sectionalizing of high voltage transmission lines and isolation in high voltage substations. As a result of this, the type ILO-C In-Line high voltage disconnect switch has been used by electric utilities for many years to isolate transmission and substation circuits.

U.S. Pat. No. 9,881,755 B1 by Charles M. Cleaveland and issued to Cleaveland/Price Inc., the present assignee on Jan. 30, 2018, discloses a communication system controlled in-line motorized high voltage disconnect switch. The switch includes an elongated strain insulator supporting an elongated rotating switch blade having a hinge contact end and a break jaw contact end. The rotating switch blade is rotatable about a hinge pin at the hinge contact end during opening and closing of the switch. The switch includes a motor connected to an output shaft to cause the hinge end of the switch blade to rotate when energized to open or close the switch. A communication system actuates the motor to cause the switch to open and close as desired. The communication system may include a number of communication devices including a portable wireless hand-held control box for communicating with a switch mounted radio. The said Cleaveland/Price Inc. patent discloses embodiments of a vertical break and a side break in-line motorized high voltage disconnect switch. Both the vertical break and side break switches include an elongated switch blade that is rotatable at one end of the switch blade, i.e., about the hinge end. Reference is also made to U.S. Pat. No. 9,966,207 B1 by Charles M. Cleaveland and issued to Cleaveland/Price Inc., the present assignee on May 8, 2018, which also discloses a communication system controlled in-line motorized high voltage disconnect switch. The said U.S. Pat. No. 9,881,755 B1 and the said U.S. Pat. No. 9,966,207 B1 are both incorporated herein by reference in their entireties as though fully set forth.

It has been found that as such in-line motorized side break switches as disclosed in U.S. Pat. Nos. 9,881,755 B1 and 9,966,207 B1 go up in voltage, i.e., above 138 kV, it is difficult to keep the weight of the switch blade from putting an excessive torsional load on the transmission line which results in "rolling of the switch" mounted to the suspension insulator. This is caused by the side break switch blade embodiment, above 138 kV, opening generally horizontally to the ground and creating an excessive torque causing the "rolling of the switch". It is the object of the present invention to provide a solution to this problem.

SUMMARY OF THE INVENTION

The problem of the described prior art side break in-line switch is solved with the present invention. The present invention provides a double break type high voltage disconnect switch which includes a horizontally rotating switch blade. The double break type high voltage disconnect switch is mounted in the transmission line in-line and includes a motor for operating the switch. The motor is mounted in the middle of and attached to the horizontally rotating switch blade, thereby the weight of the long switch blade is counterbalanced. This allows such an in-line mounted switch to operate with voltages 230 kV or higher, such as 500 kV.

The in-line double break disconnect switch includes a pair of ganged electrical insulators coaxially aligned with one another with each insulator having an end supported and attached to the transmission line in one embodiment. The other end of each insulator is retained and supported between a mechanical tie connection member such as upper and lower tie plates. The upper tie plate also supports the motor housing that houses the motor for operating the switch. A long horizontally rotating switch blade including a top blade and an oppositely disposed bottom blade positioned parallel to the top blade is supported in the longitudinal middle by the motor output shaft. The motor output shaft passes through the upper and lower tie plates. The transmission line tension load is carried by the two insulators that are joined at the tie plates by retaining pins mounted to the upper and lower tie plates. The insulator retaining pins are each attached with the upper and lower insulator tie plates. A pair of break jaws are included with each switch having a terminal connected in circuit with each transmission line end. Each break jaw makes electrical and physical contact with one end of the long switch blade upon closing of the long switch blade.

The in-line double break disconnect switch includes the long switch blade that is rotatable horizontally by the motor output shaft for final opening in an open non-conductive position 90 degrees to the transmission line and for final closing in a closed conductive position in line with the transmission line and in parallel spaced arrangement there-with. The joined pair of elongated strain insulators are coaxially aligned with one another in operation and are connected as mentioned near their inner ends to one another by the upper and lower tie plates. The joined pair of elongated strain insulators, in one embodiment, are suspended between the ends of the transmission line.

A drive assembly including the motor is operatively mounted to the upper tie plate of the switch. The motor output shaft is vertical and passes through a first opening in the upper tie plate between the inner ends of the ganged pair of elongated strain insulators. The lower tie plate is fastened to the above-mentioned pins that pass through the eye end-fitting on the end of each of the insulators. The lower tie plate includes a second opening. The output shaft of the motor passes through the second opening of the lower tie plate. The motor output shaft is fastened to the top of the long rotating switch blade in the middle of the long rotating switch blade. The weight of the switch blade is thereby counterbalanced with half of the weight on each side of the motor output shaft. This division of weight of the switch blade by the central placement of the connection of the motor output shaft creates a left section of the switch blade that extends on one side of the transmission line when opening by rotating horizontally while simultaneously a right section of the switch blade extends on the opposite side of the transmission line thereby resulting in counterbalancing of the switch blade and elimination of the described prior art "rolling of the switch". This allows the in-line double break switch of the present invention to accommodate voltages such as 230 kV or higher, such as 500 kV.

The in-line double break switch of the present invention may be operated by a communication system that controls the switch mounted motor. A hookstick can also be used to operate the switch by rotating the worm of the worm gear of the motor drive assembly in the event the motor is inoperative. The communication system may include a plurality of communication devices such as radios. A switch mounted high powered radio can command the motor to open or close the switch for automating the utility system. The radio controlled motorized in-line double break switch is preferably powered by a solar charged battery which also powers the switch mounted radio and a remote terminal unit, i.e., RTU device. The RTU is a microprocessor-controlled electronic device that receives a radio signal and decodes the signal to operate a relay that energizes the motor to open or close the switch.

In a three-phase electric power installation the present invention provides in one embodiment three (3) motorized in-line double break switch disconnect switches, one for each phase, each with a battery and solar panel for charging the battery. A current transformer could also be used to charge the battery in addition to solar panels as long as current flows in the line. One phase can also be provided with a long range radio for long distance transmitting to an electric utility control room and all three phases can communicate with each other via three (3) short distance radios, one for each phase, which allow the three switches of this embodiment of a three-phase installation to be activated simultaneously.

The in-line double break disconnect switch of the present invention includes a switch mounted worm gear drive including a worm screw coupled to and activated by the switch motor. A worm gear is operatively attached to the motor output shaft which engages the elongated double break switch blade. When the in-line switch mounted motor is energized the worm gear rotates causing the double break switch blade member to rotate, as a result causing the switch blade to rotate about the axis of the motor output shaft to the open or the closed position. At both ends of the double break switch blade is a moving arc horn configured to contact a stationary arc horn when the switch is closed. The transmission line for each of the double break switches is cut in two or split at the switch. In one embodiment each in-line double break high voltage switch includes the ganged pair of polymer strain insulators which are provided with transmission line connection points at the outer end of each in the form of clevises and dead-end fittings for respectively mounting each cut end of the transmission line to the respective polymer insulator which carries the strain load of the line. The in-line double break disconnect switch of the present invention therefore hangs on the transmission line. The transmission line at a first cut end is electrically connected to a first switch break jaw terminal at the outer end of one of the elongated polymer insulators. The second cut end of the transmission line is electrically connected to a second switch break jaw terminal at the outer end of a second of the elongated polymer insulators of the ganged pair of elongated polymer insulators. In an alternative embodiment a third elongated polymer strain insulator is connected to the second elongated polymer insulator's outer end instead of the second elongated polymer insulator being connected to the second cut end of the transmission line for the purpose of suspending the switch from a utility pole.

The radio controlled in-line motorized double break disconnect switch of the present invention, when operable by a hookstick can include an eye ring operatively affixed to the worm so that the switch may still be manually turned with a hookstick or hot stick which engages the eye ring. This inclusion of the eye ring is desirable in case the motorized portion of the switch is inoperable electrically.

A housing is mounted to house the motor and other components of each in-line motorized double break disconnect switch. The housing encloses the worm drive and motor and other associated apparatus. For example, the housing can typically enclose and support devices such as, the battery, power and control boards, transformer, switch mounted radio and fuses. On the exterior of the housing one or more solar panels for powering the battery may be mounted. Also, one or more radio antennas can be mounted to the housing for communication.

The radio controlled in-line motorized double break high voltage disconnect switches of the present invention do not require a dedicated structure to mount them in a traditional manner, such as mounted to a metal framework, which results in advantageous commercial value for electric utilities that are automating their systems. By eliminating the traditional dedicated mounting support structures, obvious cost savings are realized by mounting the switch in the transmission line.

In an alternative embodiment, the above-mentioned three (3) short distance switch mounted radios may communicate with a short range radio housed in an enclosure at ground level which allows local operation of the three (3) motorized in-line high voltage double break disconnect switches from local controls at ground level and allows operation via the utility communication network between a ground level long distance radio and the utility control room radio. The ground level long range radio allows longer distance transmitting and a much larger solar panel mounted on the ground level enclosure, than switch mounted solar panels, allows collecting solar power in an area with little sun light or the long range radio mounted at ground level may be powered by a local AC source.

In other alternative embodiments, the radio controlled motorized in-line double break disconnect switch of the present invention may be used in a 3-way or 2-way switch assembly arrangement utilizing a utility pole for support in a three phase side by side switching arrangement or in a phase over phase, three phase arrangement. In a 3-way switch assembly arrangement, three of the radio controlled motorized in-line double break switches would be used per phase to route power in any one of three different directions. Each radio controlled motorized in-line double break switch includes a switch mounted short distance radio and each three phase arrangement also includes one long distance radio to communicate with the utility control room radio. In a ground level arrangement case, a short distance radio and the long distance radio will be housed in the ground level housing. The ground level long range radio will have the capability to communicate with an additional radio located at a distance in an electric utility control room. The three or two switches per phase may be radio controlled to open and close the switches simultaneously or independently as desired to route power in different directions or isolate a circuit for maintenance.

The radio controlled motorized in-line double break disconnect switch of the present invention may also include a vacuum interrupter or a quick break whip in order to interrupt current. Another embodiment of the communication system to simultaneously operate all three phases together could be a fiber optic connection between phases or phase to ground, not shown in the drawings, instead of the use of radio control. Still another embodiment is a communication system using a hand held radio controller which can command the switch to open or close.

These and other aspects of the present invention will be further understood from the detailed description of the particular embodiments, drawings and claims.

DETAILED DESCRIPTION OF THE PARTICULAR EMBODIMENTS

Figure 1:
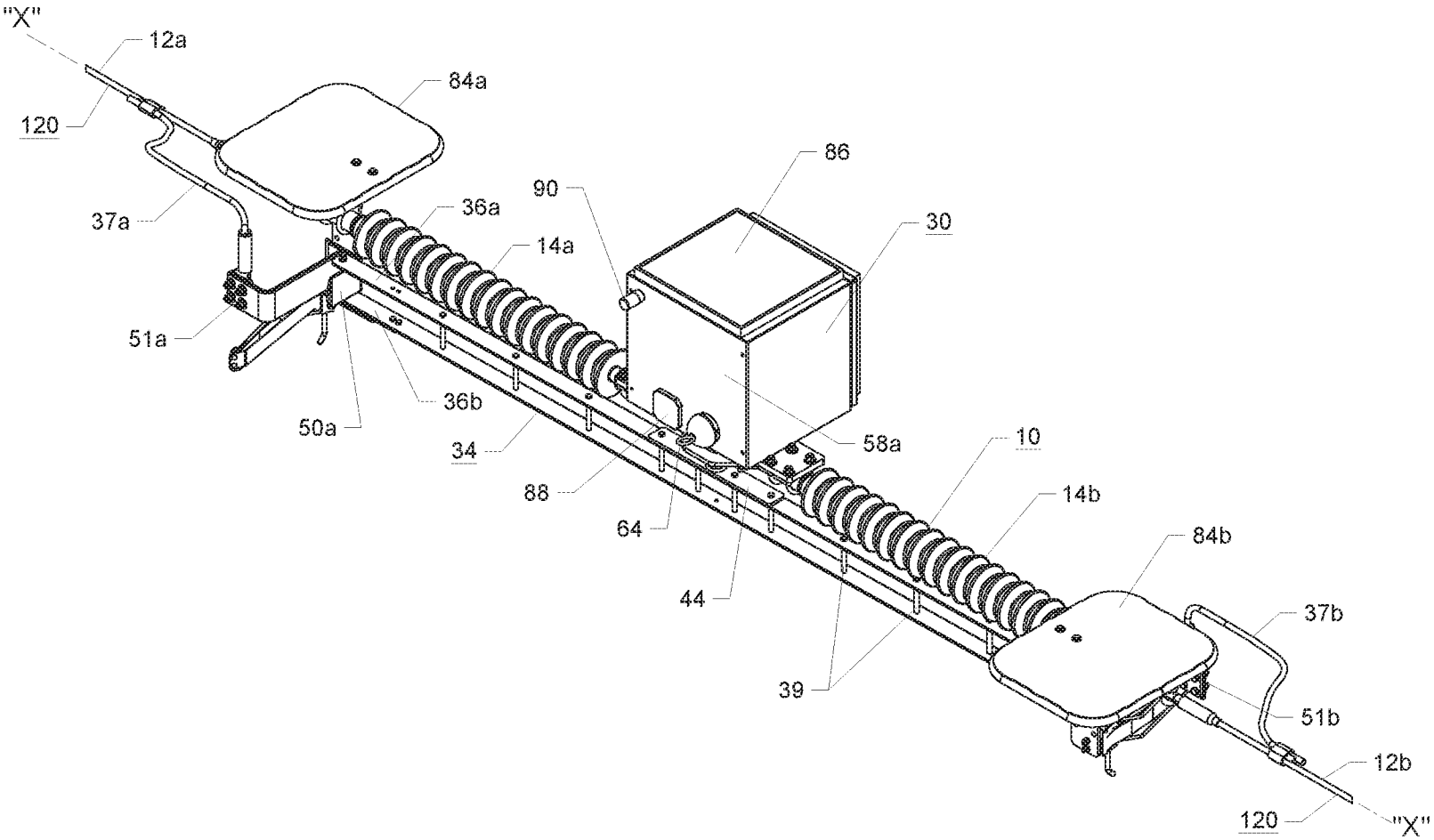
FIG. 1 is a perspective view of the motorized in-line double break high voltage disconnect switch with a horizontally rotating switch blade of the present invention with the solar panels and long range and short range antennas shown and the switch shown in the closed position.
Figure 2:
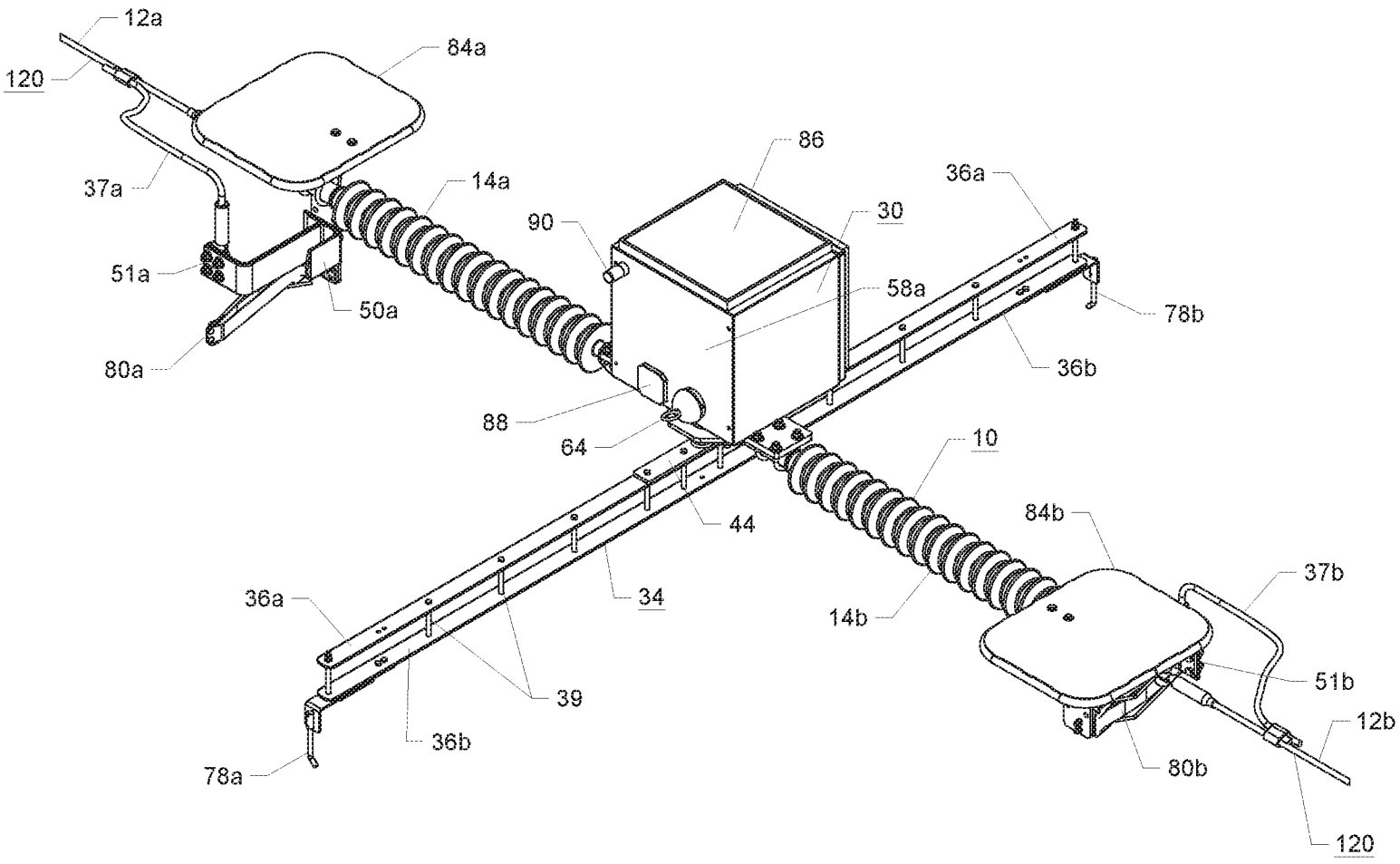
FIG. 2 is the same switch shown in FIG. 1 with the switch open.
Figure 3:
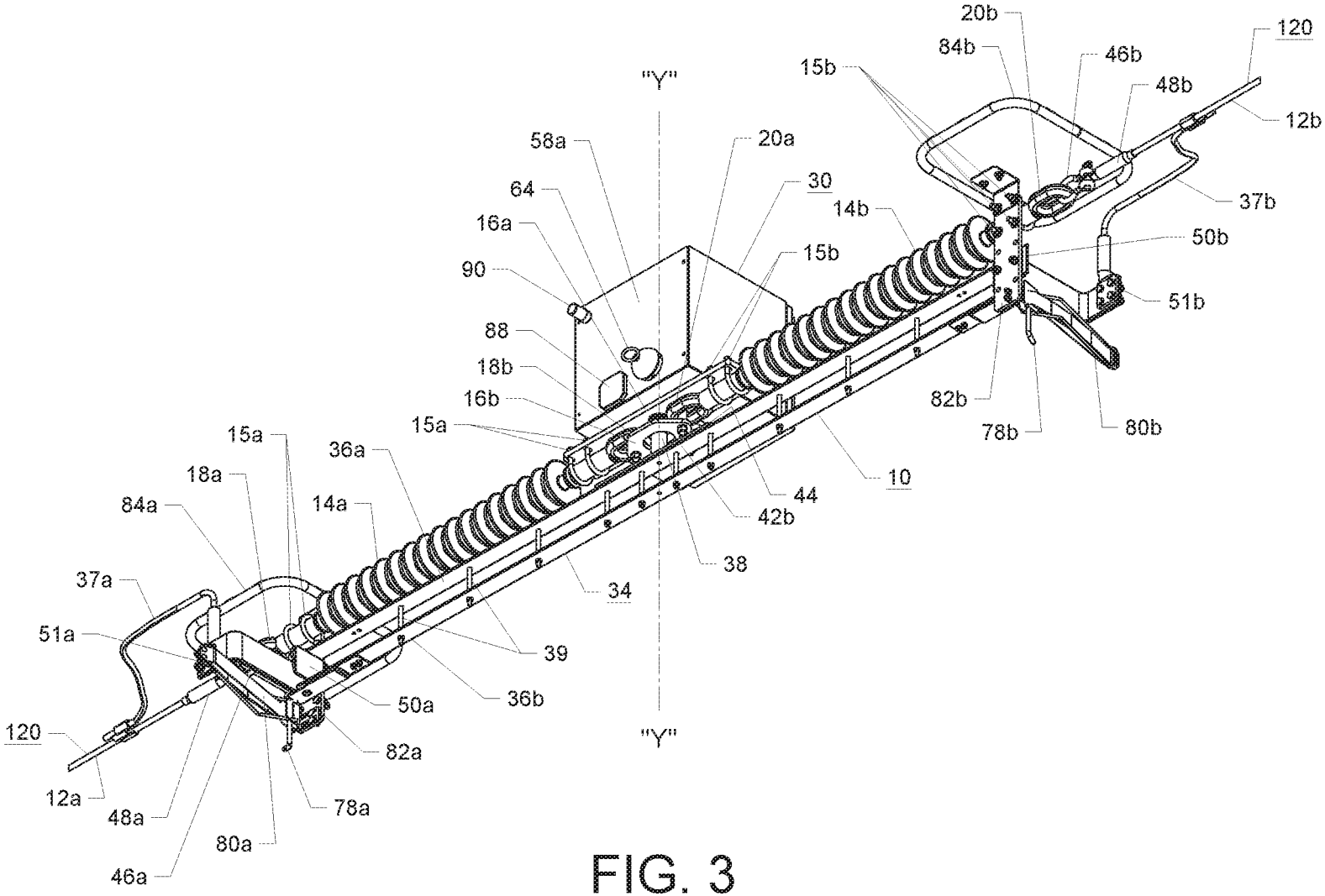
FIG. 3 is a view of the same switch shown in FIG. 1 looking up from the ground to the underside of the switch.
Figure 4:
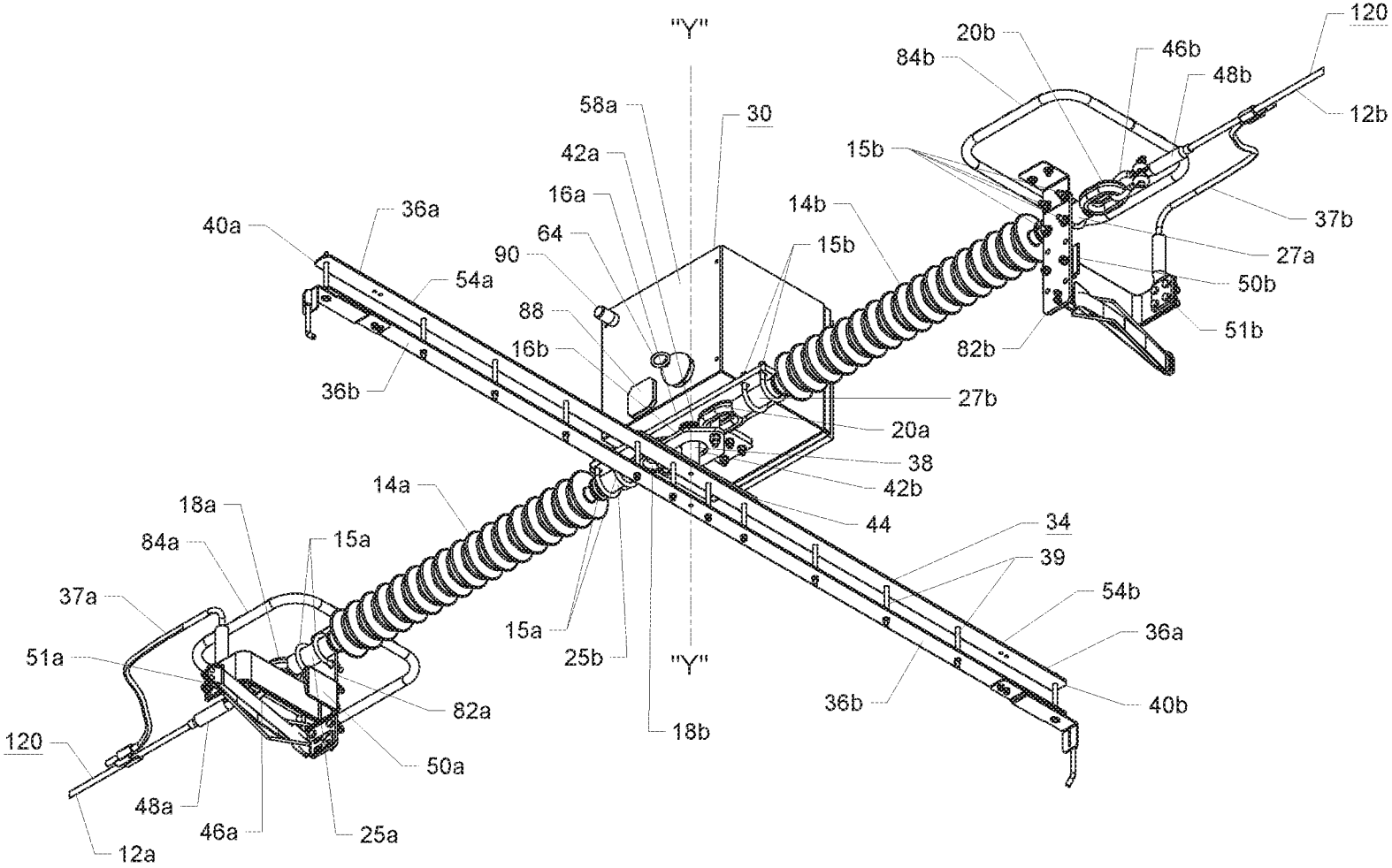
FIG. 4 is same as FIG. 3 but with the switch open.

With reference to FIGS. 1-4, there is shown a radio controlled motorized in-line high voltage double break disconnect switch 10 of the present invention operatively suspended by and between cable conductors 12*a*, 12*b* of the transmission line conductor 120. With reference to FIG. 1, the in-line double break disconnect switch 10 of the present invention includes a pair of ganged elongated coaxially aligned polymer strain insulators 14*a*, 14*b*. As can be seen in FIG. 4, the first polymer insulator 14*a* has mounted at its respective first end 25*a* and second end 25*b* first chain eye fittings 18*a*, 18*b*. The second polymer insulator 14*b* has mounted at its respective first end 27*a* and second end 27*b* second chain eye fittings 20*a*, 20*b*. The chain eye fittings 18*a*, 20*a* are attached respectively by clevises 46*a*, 46*b* and dead-end fittings 48*a*, 48*b* for respectively mounting each cut end of the transmission line 120, i.e., cable conductor 12*a*, 12*b* to the respective polymer insulator 14*a*, 14*b* which together carry the strain load of the transmission line. The in-line high voltage double break disconnect switch 10 of the present invention as a result hangs on and is suspended by the transmission line 120.

Figure 5:
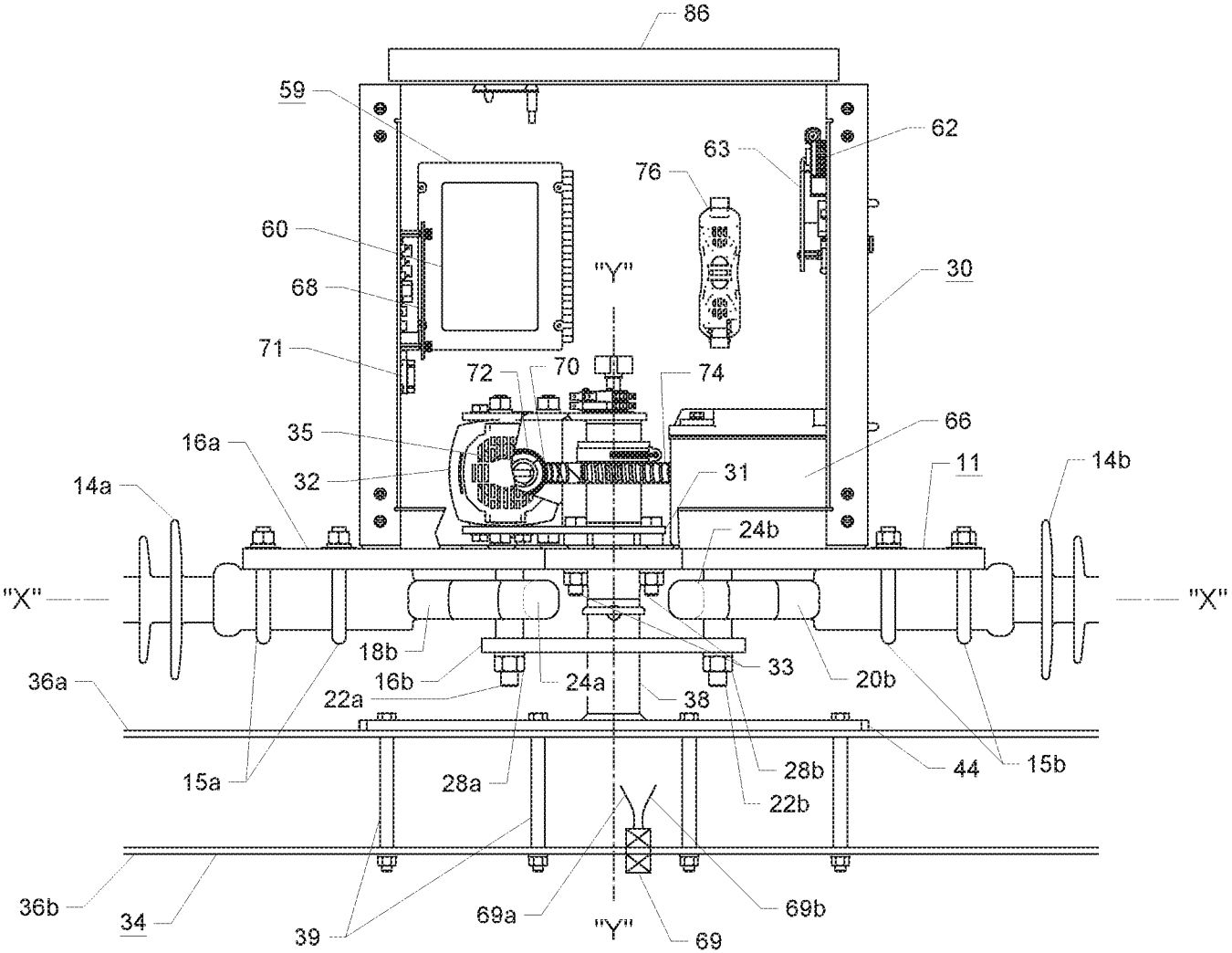
FIG. 5 is a partial frontal view of the in-line double break disconnect switch shown in FIGS. 1, 2, 3 and 4 of the present invention showing the components mounted within the housing with the front panel removed.

As shown by reference to FIGS. 1 and 5, the ganged elongated polymer strain insulators 14*a*, 14*b* are coaxially aligned with one another along axis "X" of the switch 10. They are joined to each other by being mounted to a mechanical tie connection member 11. The mechanical tie connection member 11 can comprise an upper insulator tie plate 16*a* and a lower insulator tie plate 16*b*. The ganged polymer strain insulators 14*a*, 14*b* are mounted between upper insulator tie plate 16*a* and lower insulator tie plate 16*b*. Insulators 14*a* and 14*b* also are secured to plate 16*a* by multiple U-bolts 15*a* and 15*b*. FIG. 3 and FIG. 4 show the U-bolts 15*a* and 15*b* also connect the mounting brackets 82*a* and 82*b* to the opposite end of insulators 14*a* and 14*b*. The upper tie plate 16*a* supports a motor housing 30 that houses a motor 32 and other control and communication components described subsequently. As seen in FIG. 5, the motor 32 is carried on a motor mounting plate 31 secured by bolts 33 to plate 16*a*. The motor 32 may be a type AC/DC having a ¾ horsepower rating, for example. A long horizontally rotating switch blade 34 is provided and includes a top blade 36*a* and an oppositely disposed bottom blade 36*b* positioned parallel to the top blade 36*a*. The top blade 36*a* is attached to the bottom blade 36*b* by blade connecting pins 39, as shown in FIG. 5 and FIG. 4. The top blade 36*a*, bottom blade 36*b* and blade connecting pins 39 are all preferably made of copper or stainless steel. The long horizontally rotating switch blade 34 is supported by a vertical motor output shaft 38 that is driven by the motor 32. The motor output shaft 38 is mounted to the top plate 44 of the top blade 36*a* with the "Y" axis thereof passing midway between longitudinal ends 40*a*, 40*b* of the switch blade 34 as shown in FIG. 4. The long switch blade 34 is therefore gravitationally balanced and horizontally rotatable by the motor output shaft 38 for final opening in an open non-conductive position, such as shown, in FIG. 4, 90 degrees to the transmission line cable conductors, 12*a*, 12*b*. For final closing in a closed conductive position it is aligned at 0 degrees to the transmission line cable conductors, 12*a*, 12*b* and spaced parallel to them. As a result of this arrangement the weight of the long switch blade 34 is counter balanced during opening of the switch and prevents tilting of the switch blade 34 vertically. As can be seen from FIG. 4, with the switch open, the weight of left section 54*a* of the long switch blade 34 counter balances the weight of the right section 54*b*, thus eliminating the prior art problem of "rolling of the switch" about the conductor 120.

Referring to FIG. 5, the switch blade 34 of the in-line double break switch 10 includes a worm gear drive 70 which includes a worm screw 72 mounted to motor shaft 35. The worm screw 72 is coupled to and activated by the switch motor 32. A worm gear 74 is operatively attached to the motor output shaft 38. When the in-line switch mounted motor 32 is energized the worm gear 74 rotates causing rotation of the long switch blade 34 about the axis "Y" of the motor output shaft 38 to fully open or close the switch 10, see FIG. 4.

As can be seen in FIG. 4, the motor output shaft 38 passes through first motor shaft aperture 42*a* in the upper insulator tie plate 16*a*. The motor output shaft 38 then passes through the second motor shaft aperture 42*b* in the lower insulator tie plate 16*b*. The motor output shaft 38 is attached to a top blade plate 44. The top blade plate 44 is attached to top blade 36*a* as shown in FIG. 5.

As can be seen in FIG. 5. a first insulator retaining pin 22*a* is mounted to the upper insulator tie plate 16*a* and extends through a first chain eye aperture 24*a* in the first chain eye fitting 18*b*. The first insulator retaining pin 22*a* then extends through a hole in first lower insulator tie plate 16*b*. The first insulator retaining pin 22*a* may be threaded at the end that passes through the first lower insulator tie plate 16*b*. First nut 28*a* engages the threading of first insulator retaining pin 22*a*. Likewise, a second insulator retaining pin 22*b* is mounted to the upper tie plate 16*a* and extends through a second chain eye aperture 24*b* in the second insulator chain eye fitting 20*b*. The second insulator retaining pin 22*b* then extends through a hole in the second lower insulator tie plate 16*b*. The second insulator retaining pin 22*b* may also be threaded at the end that passes through the hole in the second lower insulator tie plate 16*b*, as shown in FIG. 5. Second nut 28*b* engages the threading of the second insulator retaining pin 22*b*.

The in-line double break disconnect switch 10 of the present invention also includes a pair of break jaws 50*a*, 50*b*, as shown in FIG. 3. Each break jaw 50*a*, 50*b* makes electrical and physical contact with the switch blade at top blade 36*a* and bottom blade 36*b* contact area of the long switch blade 34 upon closing of the long switch blade 34, as can be seen by reference to FIGS. 1 and 2, for example. The double break switch 10 also includes jumpers 37*a*, 37*b*. Jumper 37*a* is attached in circuit between the one cable conductor 12*a* and one break jaw terminal 51*a*. The other jumper 37*b* is attached in circuit between the other cable conductor 12*b* and the other break jaw terminal 51*b*.

At both ends of blade 34 of the switch 10 is mounted respectively moving arc horns 78*a*, 78*b*, as can be seen in FIG. 2. The moving arc horns 78*a*, 78*b* are configured to respectively and operatively contact stationary arc horns 80*a*, 80*b*. As seen in FIG. 3, one stationary arc horn 80*a* is mounted to one mounting bracket 82*a* and the other stationary arc horn 80*b* is mounted to another mounting bracket 82*b*. The break jaw terminals 51*a*, 51*b* are also respectively mounted to mounting brackets 82*a*, 82*b* as can be seen by reference to FIG. 3, for example. Ice shields 84*a* and 84*b* are desirably included to shield the break jaws 50*a*, 50*b* from ice build up that would impair switch opening and closing. One ice shield 84*a* is preferably mounted over the one break jaw 50*a* and the other ice shield 84*b* is mounted over the other break jaw 50*b* as shown in FIG. 3. The one mounting bracket 82*b* supports the one ice shield 84*b* and the other mounting bracket 82*a* supports the other ice shield 84*a* as shown in FIG. 3 and FIG. 4.

Figure 10:
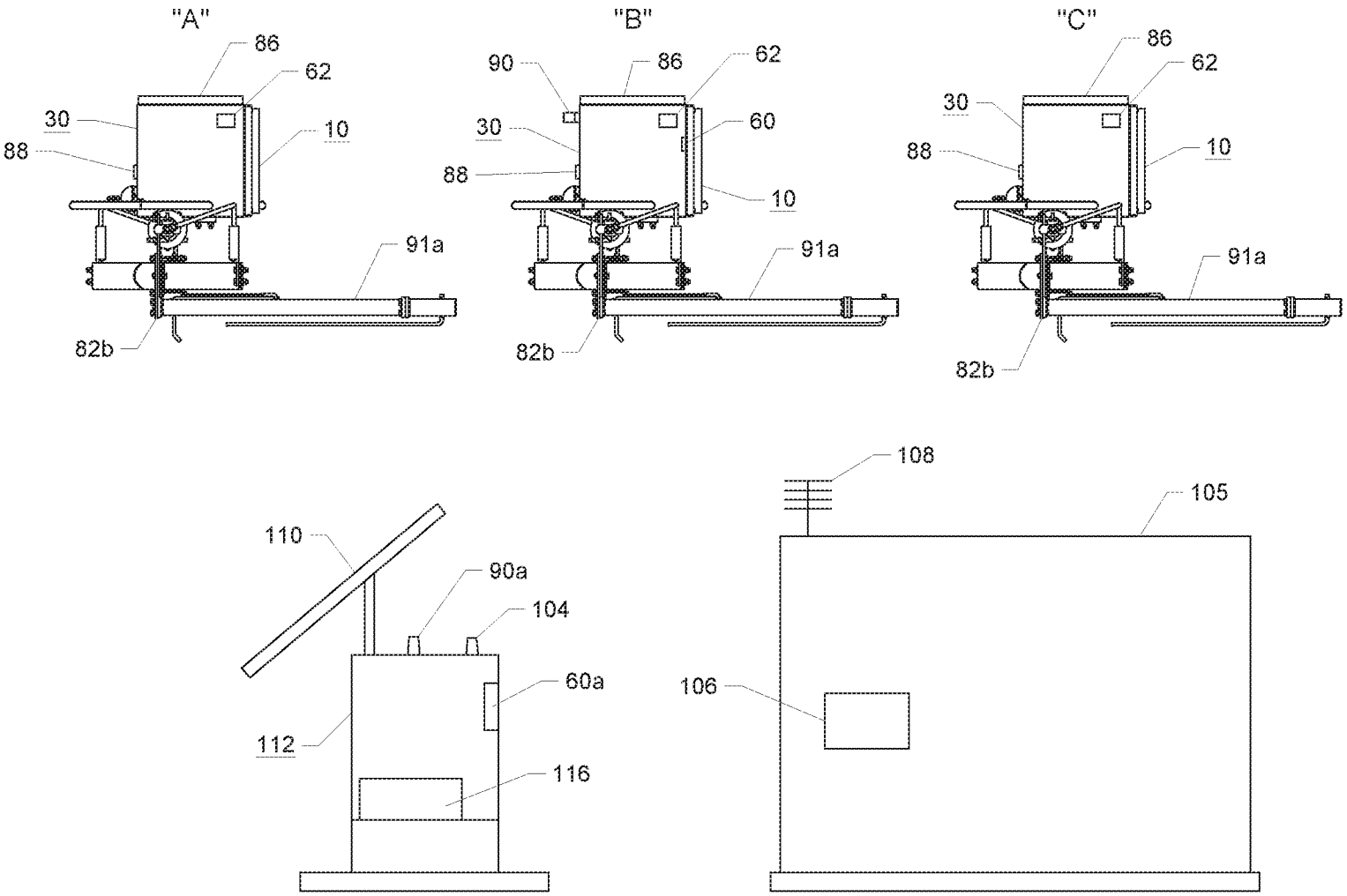
FIG. 10 is the same as FIG. 9, but a larger solar panel and the higher power long range radio and larger battery are disposed at ground level within a ground level enclosure and also shown is the utility control room for communication to the ground level enclosure.

FIG. 5 shows the radio controlled motorized in-line high voltage double break disconnect switch 10 of the present invention with the housing 30 having a front panel 58*a* removed to expose the interior of the housing 30. The radio controlled motorized in-line double break switch 10 may include a communication system 59. The communication system 59 may in one embodiment include a high power radio 60 and a low power radio 62 which can be mounted in the housing 30 as shown in FIG. 5. The high power radio 60 in one embodiment can communicate directly with a utility control room 105 with high power radio 106 as shown in FIG. 10 via antenna 108. The switch mounted high power radio 60 can receive a command from high power radio 106 to operate the motor 32 to open or close the switch 10. Alternatively, as mentioned previously, a hookstick, not shown in the drawings, can also be used to operate the switch by manually engaging an eye ring 64 shown in FIG. 1 to rotate the motor shaft 38. The eye ring 64 is operatively attached to the worm screw 72 so that the motor shaft 38 may still be manually turned with a hookstick or hot stick, not shown in the drawings, that engages the eye ring 64. This inclusion of the eye ring 64 is desirable in case the motorized portion of the switch is inoperable electrically.

The double break switch 10 preferably includes a solar charged switch mounted battery 66 for powering the motor 32, the switch mounted high power radio 60, if used, and low power radio 62 as shown in FIG. 5. A fuse 76 may also be housed in the housing for protecting the motor circuit. The solar charged switch mounted battery 66 also powers a remote terminal unit 71, i.e. RTU device, mounted to power board 68. A remote terminal unit (RTU) such as manufactured and sold by Cleaveland/Price Inc. as model no. RTU 3212 may be used for this application. A solar panel 86 is mounted on the housing 30 such as shown in FIG. 5 and is used for charging the battery 66.

Figure 6:
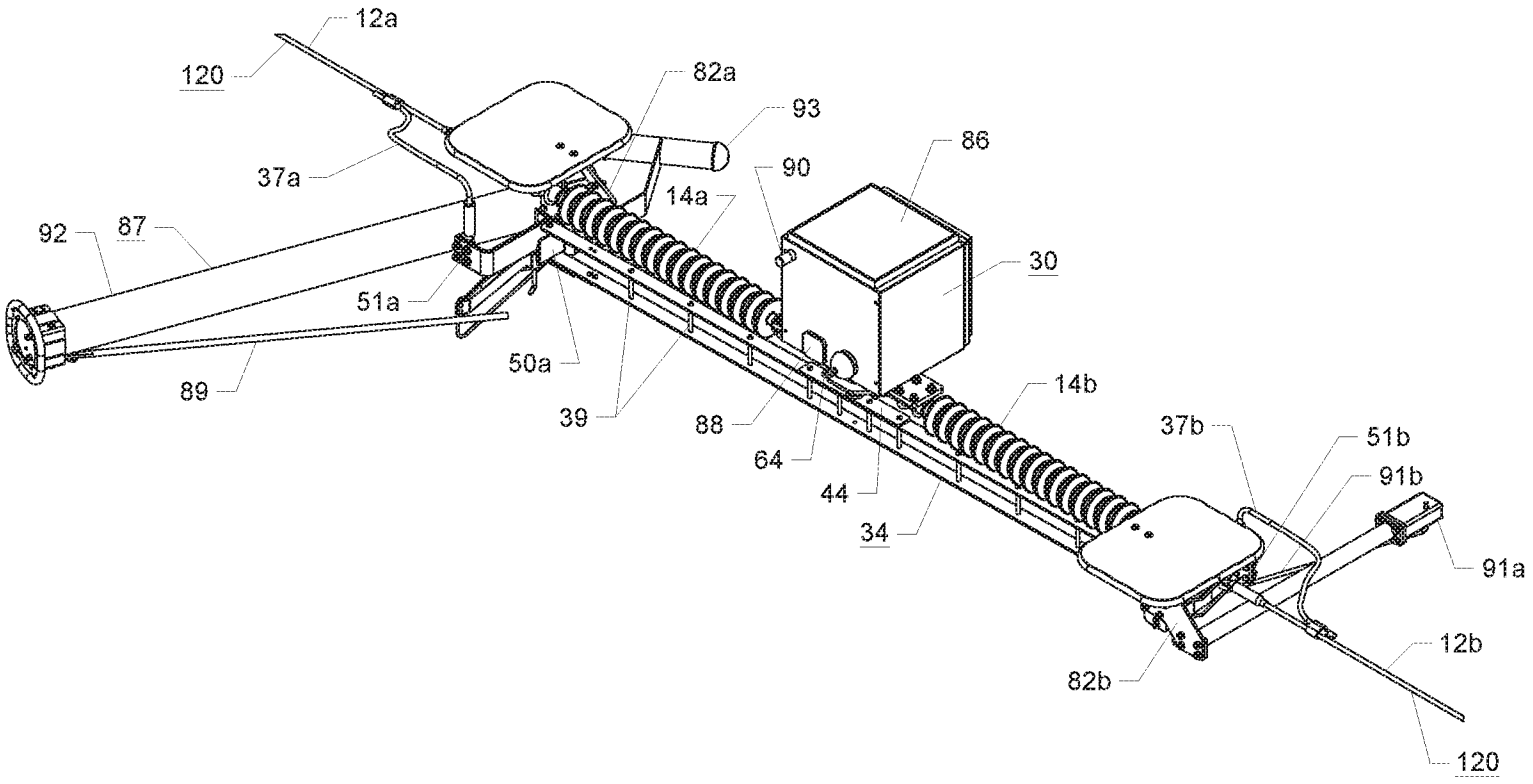
FIG. 6 is a perspective view of an in-line double break disconnect switch of the present invention carrying a vacuum interrupter, showing the switch in the closed position.
Figure 7:
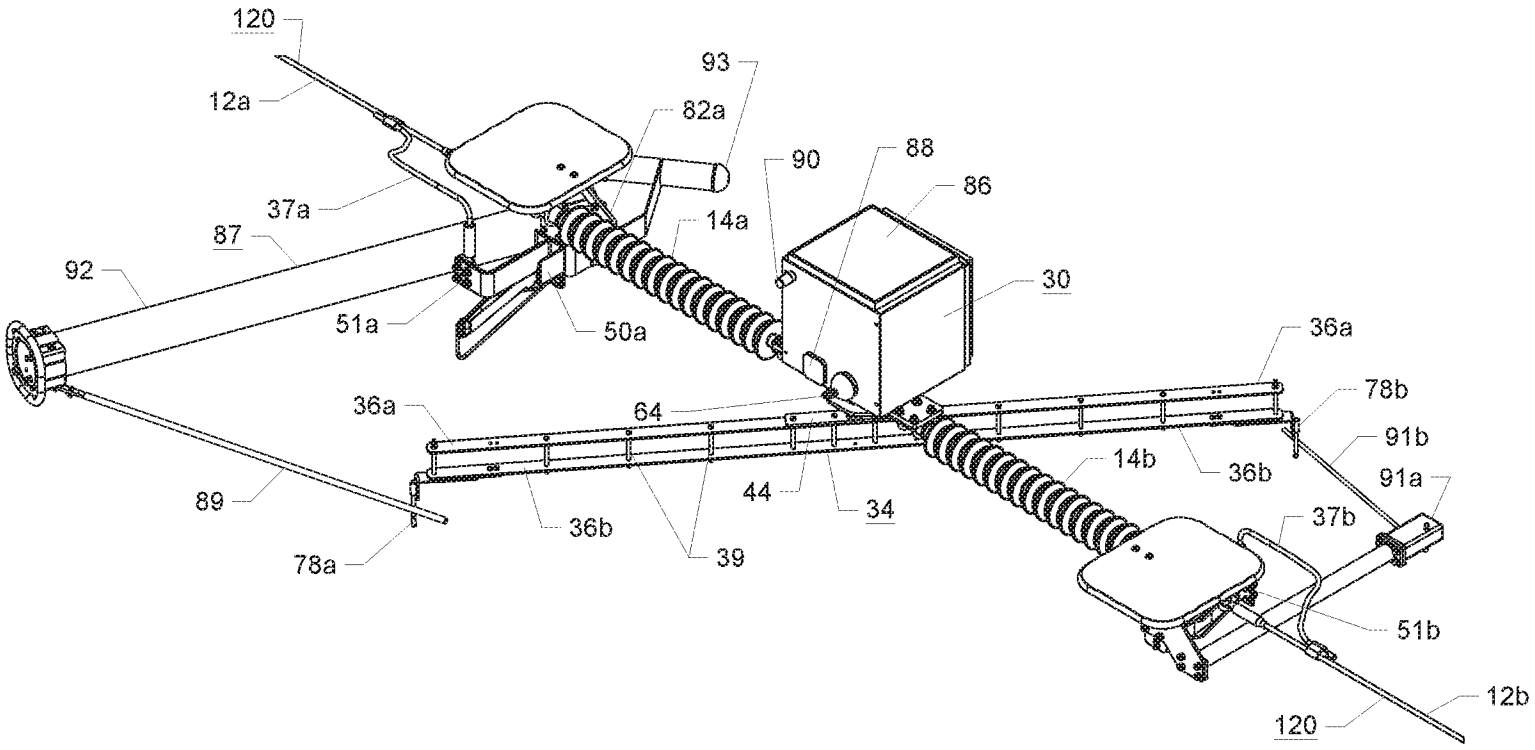
FIG. 7 is the same as FIG. 6 but the switch is partially open.
Figure 8:
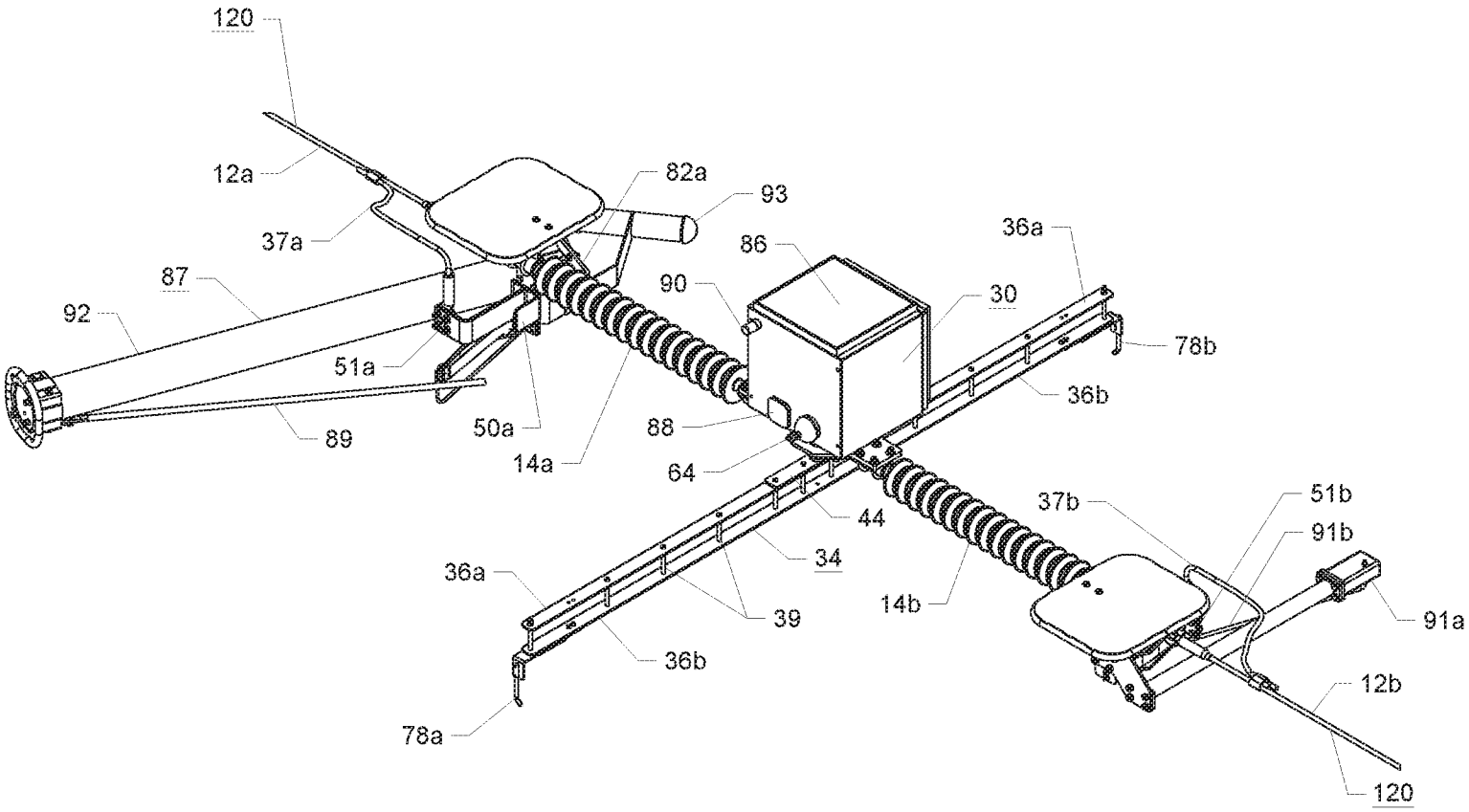
FIG. 8 is the same as FIG. 6 but the switch is completely open.

FIG. 6 is a perspective view of an in-line double break disconnect switch 10 of the present invention carrying a vacuum interrupter 87 showing the switch 10 in the closed position. FIG. 7 is the same as FIG. 6 with the switch 10 partially open. FIG. 8 is the same as FIG. 6 but the switch is completely open. The vacuum interrupter 87 is attached proximate to the mounting bracket 82*a*. A spring loaded arc horn assembly 91*a* is attached at the opposite end of the switch 10 to mounting bracket 82*b*. As can seen in FIG. 7, as the switch blade 34 opens, moving arc horn 78*a* contacts trip arm 89 of the vacuum interrupter 87. At the same time, moving arc horn 78*b* contacts spring loaded arc horn bar 91*b* which follows the blade 34 as it opens. Also attached proximate to the mounting bracket 82*a* is a counter balance weight 93 for balancing the weight of the vacuum interrupter 87, which puts a torsional load on the cable conductor 12*a*. Such a vacuum interrupter device including multiple vacuum bottles connected in series circuit arrangement to extinguish an arc are well known, such as described in U.S. Pat. No.: 4,492,835 to John L. Turner, issued Jan. 8, 1985. As the blade 34 rotates the trip arm 89 of the vacuum interrupter 87 is contacted by the moving arc horn 78*a* for tripping the internal mechanism of the vacuum interrupter 87 and while likewise the spring loaded arc horn bar 91*b* is contacted by the moving arc horn 78*b* for maintaining the electric current path through the vacuum interrupter 87 until the vacuum interrupter 87 trips open the circuit. The internal mechanism of the vacuum interrupter 87 is not shown in the drawings. The housing 92 of the vacuum interrupter 87 contains the internal mechanism, that actuates the vacuum bottles, not shown in the drawings, contained within the housing 92 to interrupt the current flowing through conductor 120. After interruption occurs, continued rotation of blade 34, as shown in FIG. 8, allows spring loaded trip arm 89 and spring loaded arc horn bar 91*b* to return to their initial position ready for close operation.

Figure 9:
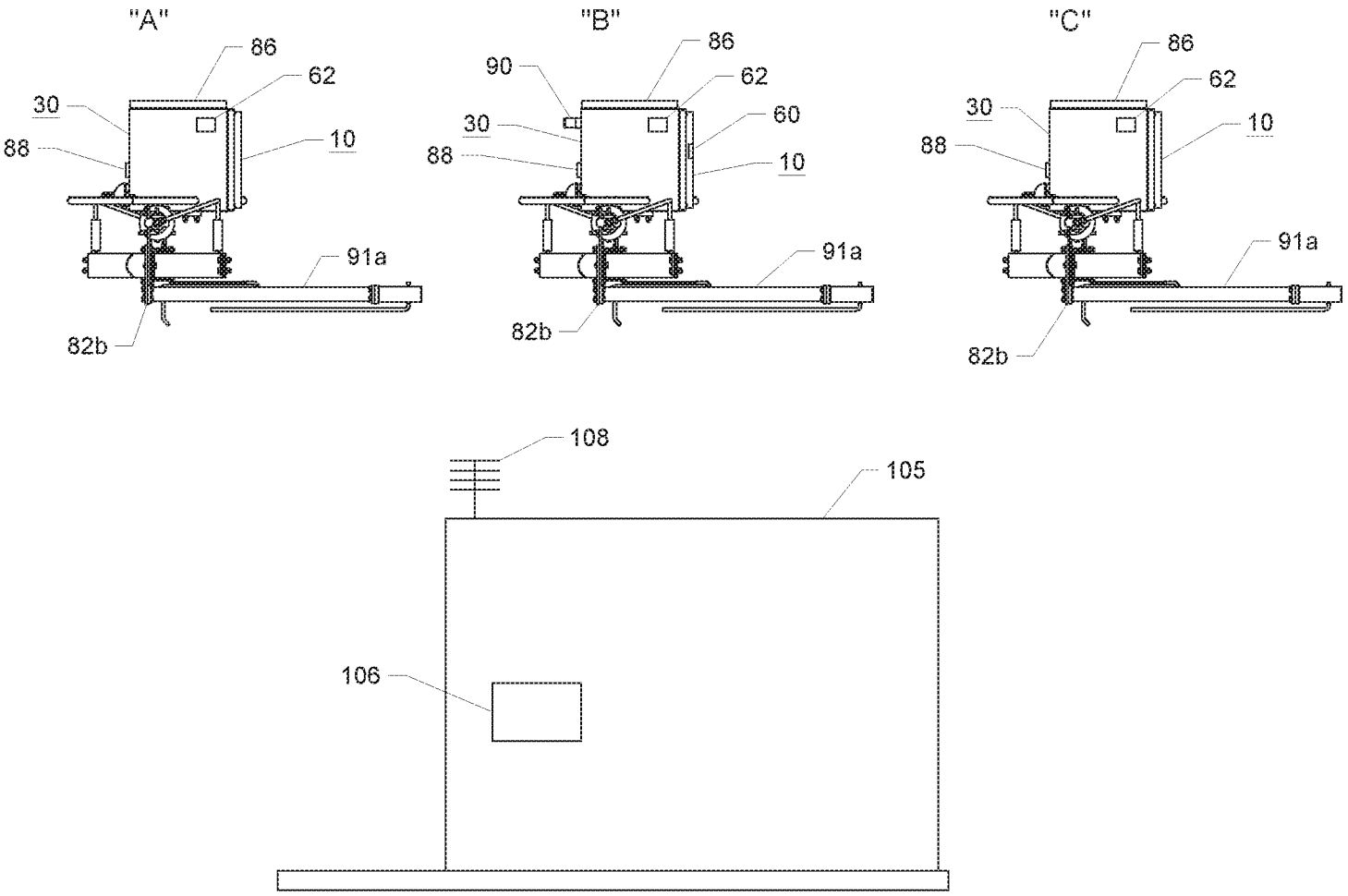
FIG. 9 is a schematic showing the present invention for the radio control embodiment with phases "A", "B", and "C" of the electric system in an end view with communication to a utility control room.

FIG. 9 shows schematically elevation views of three radio controlled motorized in-line double break disconnect switches 10 of the present invention. The double break disconnect switch 10 of this embodiment is operatively arranged in each of the phases "A", "B", and "C" of an electric utility system. Each switch 10 of the three phases "A", "B", and "C" may contain, as mentioned, a switch mounted low power radio 62, as also shown in FIG. 5, which utilizes attached low power radio antenna 88, shown in FIG. 1 also, (actually mounted to the front panel 58*a*—removed in FIG. 5 to show interior components) to communicate with the other phases. Also, one of the switches 10 is provided with a high power radio 60 and a first high power antenna 90, as shown in phase "B" of FIG. 9 for long distance communicating to a control room 105. In this embodiment first high power antenna 90 can be used for distance receiving and transmitting directly to control room 105 by communicating with high power radio 106 via control room antenna 108. The control room antenna 108 can be mounted on the utility control room 105. The utility control room 105 may be located at a substantial distance from the switches 10, such as 50 miles. The three switches 10 mounted in the three phases "A", "B", and "C" communicate with each other via the three low power radios 62 using low power antennas 88; which allow the three switches 10 of the three phases "A", "B", and "C" to be actuated simultaneously. The present invention is also very beneficial for electric utilities because there is no need for a dedicated ground support structure to mount switches in a traditional manner.

FIG. 10 shows schematically, in another embodiment, elevation views of three radio controlled motorized in-line double break disconnect switches 10, which like the previous embodiment shown in FIG. 9, are each operatively arranged on the phases "A", "B", and "C" of an electric utility system. Each switch 10 of the three phases "A", "B", and "C" may contain, as mentioned, a switch mounted low power radio 62, as also shown in FIG. 5, which utilizes attached low power radio antenna 88 to at least communicate with the other phases. A utility room operator at the utility control room 105 may open or close the switch 10 by transmitting a radio command from the high power antenna 108 to the ground level antenna 104 mounted on ground level enclosure 112, for example, and high power transceiver 60*a* which communicates from antenna 90*a* to the switch antenna 90, which as shown in FIG. 10, is mounted in phase "B" of the three phase switching arrangement which is connected to the high power transceiver/radio 60 carried by the switch in phase "B". The signal is translated via the RTU, i.e., remote terminal unit, to operate the contacts, not shown, on the control board 63 which energizes the motor 32 to rotate motor shaft 38 in one direction or the opposite direction to open or close the switch 10.

FIG. 10 also shows an additional embodiment, where a larger solar panel 110 can be mounted as shown to the ground level enclosure 112. The larger solar panel 110 is useful for areas with less sun to power a large ground level battery 116 which can power the high powered transceiver 60*a*, which can communicate open and close status information to control room 105.

A current transformer 69, shown in FIG. 5, may be mounted around the bottom blade switch conductor 36*b* and can be used to provide additional power to charge the battery 66 as long as current flows in the conductor 36*b* when the switch is closed. The current transformer 69 has leads 69*a*, 69*b* which provides power to power board 68 to charge battery 66.

Figure 11:
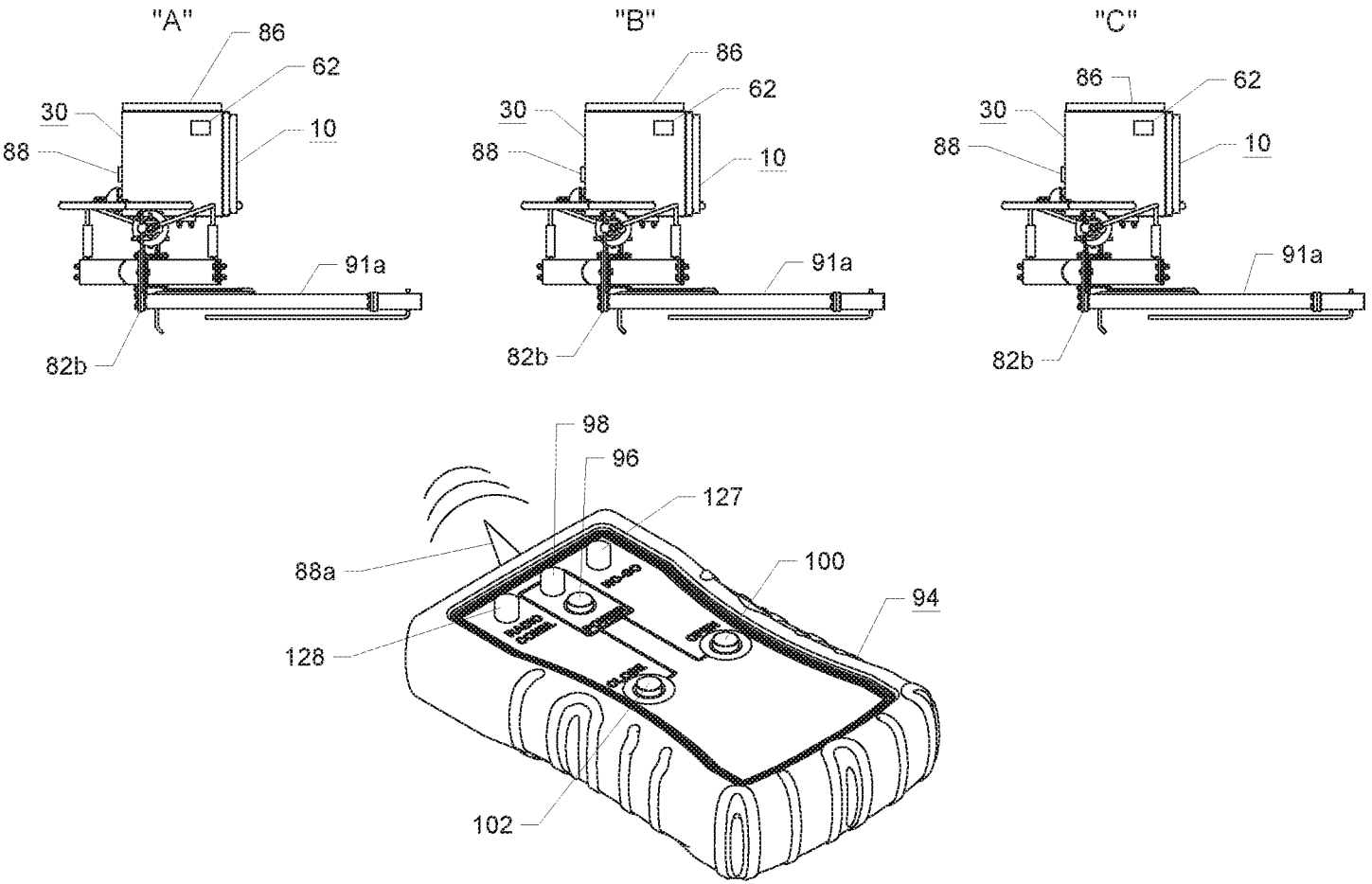
FIG. 11 is a schematic showing the present invention for the hand-held controller embodiment with phases "A", "B", and "C" of the electric system in an end view.

FIG. 11 shows another embodiment whereby a utility worker can open or close the switch 10 by way of sending a radio command from the hand-held controller 94, via antenna 88*a*, to the three phase switching arrangement communicating via antennas 88 on each switch and the signal is translated via the RTU, i.e., remote terminal unit, to operate relay contacts, not shown, on the control board 63 which energizes the motor 32 to rotate the switch blade 34 in one direction or the other to open or close the switch 10. As shown in FIG. 5, the power board 68 takes power from the solar panel 86 and charges the battery 66 at a rate that does not over charge the battery to run the motor 12 at 125 VDC. As mentioned the power board 68 includes an inverter, not shown, that converts 12 VDC to AC. A transformer, not shown in the drawings, raises the voltage to 125 VAC which is rectified by the power board 68 to 125 VDC. The fuse 76 protects the circuit. The low power radio 62 shown in FIG. 5 in each phase receives a communication from the hand-held controller 94 to open simultaneously all three switches 10 or otherwise as desired. The hand-held controller 94 may include a momentary button 96 and a light 98 for indicating power is on, as shown in FIG. 11. The hand-held controller 94 may also include an open button 100 and a close button 102 for opening and closing the switches 10. Of course, other controls can be added to the hand-held controller 94, such as light 127 which indicates that the battery 66 is low on voltage to the point that the switch will not operate and light 128 which indicates that the radio is communicating.

Figure 12:
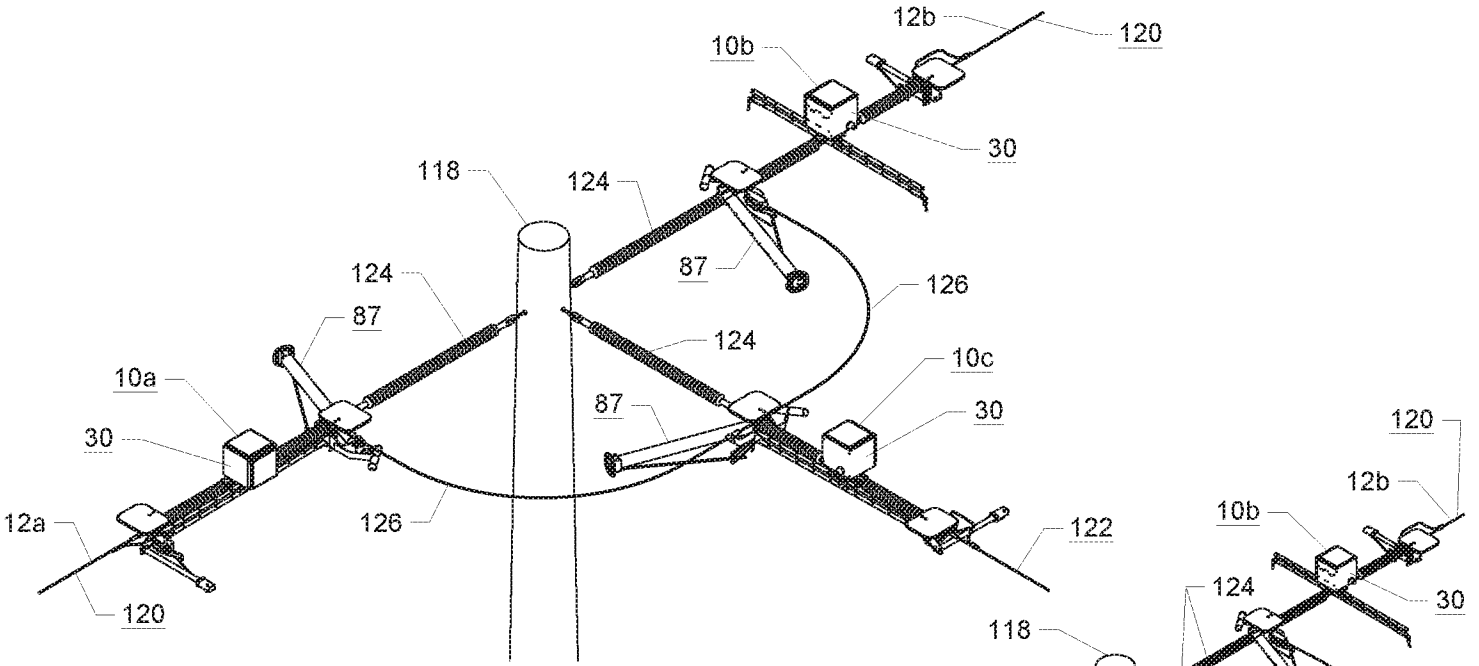
FIG. 12 is a perspective view of one phase of the 3-way switching arrangement of the present invention supported by a utility pole with two switches closed and one switch open each carrying a vacuum interrupter.
Figure 13:
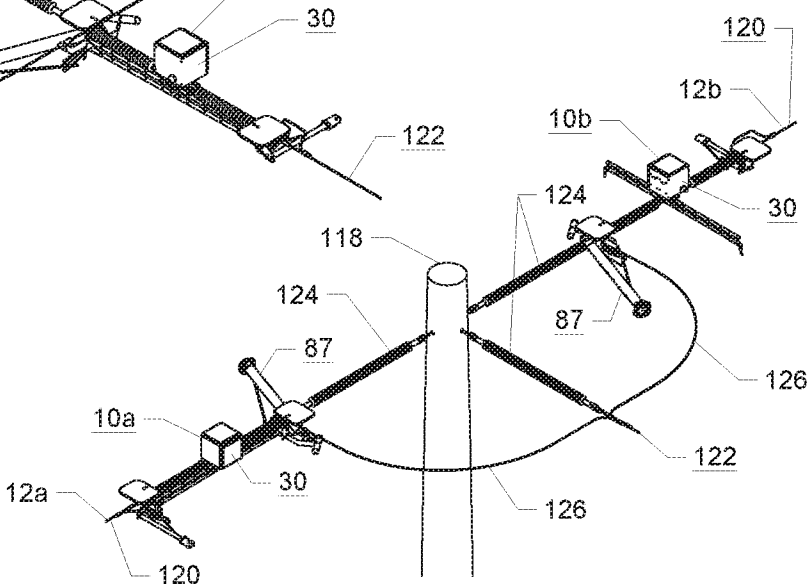
FIG. 13 is a perspective view of one phase of the 2-way switching arrangement of the present invention supported by a utility pole with one switch closed and one switch open carrying vacuum interrupters and a conductor to transmit power to either switch; and, FIG. 14 is a perspective view of a three phase, phase over phase, 3-way switching arrangement utilizing three in-line double break disconnect switches per phase each switch shown in the closed position and each carrying a vacuum interrupter.

FIG. 12 shows one phase of a three phase installation of a 3-way switching arrangement of the present invention supported by a utility pole 118. The switching arrangement shown in FIG. 12 includes three double break motorized in-line switches, which in this embodiment are identified as switches 10*a*, 10*b* and 10*c*, which are each suspended in part by the utility pole 118. The transmission line cable conductors 12*a*, 12*b* result from cutting a first transmission line 120. The cable conductors 12*a*, 12*b* are attached respectively to switches 10*a* and 10*b* with a second transmission line 122 attached to switch 10*c*. FIG. 12 shows switches 10*a* and 10*c* in the closed position while switch 10*b* is in the open position. Also, three additional polymer strain insulators 124 suspend each switch 10*a*, 10*b*, 10*c* to the pole 118, via traditional hardware. Jumpers 126 electrically connect switches 10*a*, 10*b* and 10*c* together. Thus, power can be routed in three different directions. This arrangement would also work for a 2-way switching arrangement, shown in FIG. 13 which is similar to the embodiment shown in FIG. 12 except without switch 10*c* but with line 122 feeding switch 10*a* or 10*b*, if switch 10*b* were to be closed and switch 10*a* opened. These switching arrangements form a two way or three way switch array. For further reference regarding two-way or three-way high voltage switching see U.S. Pat. No. 9,355,797 B1, entitled Unitized Phase Over Phase Two-Way or Three-Way High Voltage Switch Assembly with One Vacuum Interrupter Per Phase, issued Mar. 29, 2015, by Charles M. Cleaveland and which is assigned to the present Assignee, Cleaveland/Price Inc. and which is herein incorporated by reference in its entirety as though fully set forth.

Figure 14:
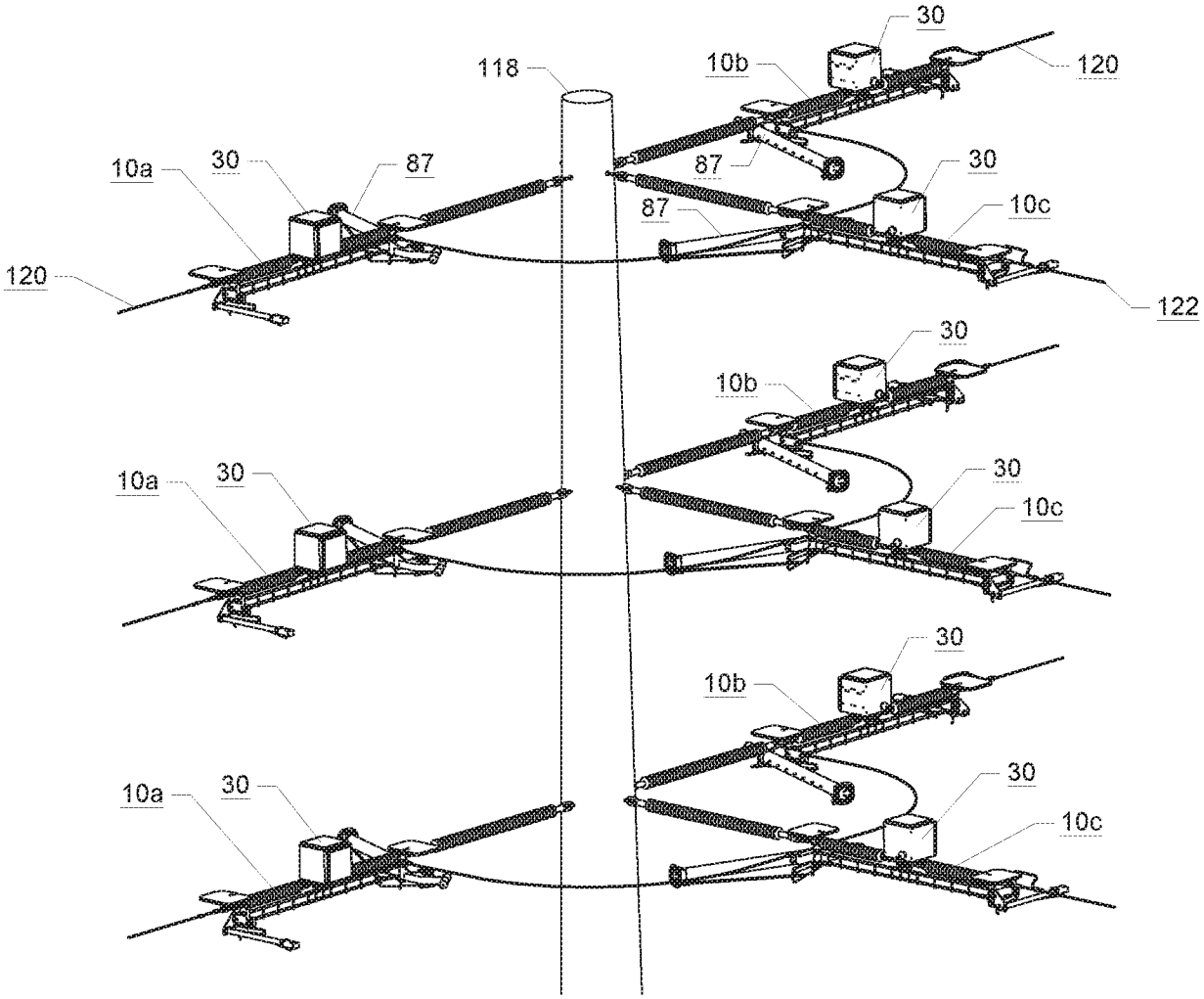

FIG. 14 shows the present invention in a three phase "A", "B", and "C", phase over phase array, mounted to a utility pole 118. Each of the phases "A", "B", and "C" includes a three-way switching arrangement. A two-way three phase switching arrangement is also feasible and similar to FIG. 13 but is not shown in the drawings. For further reference in this regard see the previously mentioned U.S. Pat. No. 9,355,797 B1. Each phase includes, for example, three radio controlled in-line double break switches 10*a*, 10*b*, and 10*c* of the present invention configured as shown in FIG. 14. Each of the switches includes the vacuum interrupter 87 as previously described. All nine (9) switches are shown in the closed position.

The embodiments disclosed are merely some examples of the various ways in which the invention can be practiced and are not intended to limit the scope of the invention.

What is claimed is:

1. A high voltage in-line motorized double break disconnect switch operatively supported and suspended by and mounted in-line with an electric power line conductor, the high voltage in-line double break disconnect switch having an open non-conductive position and a closed conductive position, the high voltage in-line double break disconnect switch comprising:

a pair of ganged coaxially aligned elongated strain insulators operatively supported and suspended by and between a first cut end and a second cut end of the electric power line conductor or by and between the first cut end of the electric power line conductor and a third elongated strain insulator, an elongated horizontally rotating switch blade extending in the closed conductive position in parallel spaced relationship with and supported by the pair of ganged coaxially aligned elongated strain insulators, a first of the ganged coaxially aligned elongated strain insulators having a first end supported and attached to the first cut end of the electric power line conductor, a second of the ganged coaxially aligned elongated strain insulators having a first end supported and attached to a second cut end of the electric power line conductor or to the third elongated strain insulator, each of the ganged pair of elongated strain insulators having a second end thereof retained and supported by a mechanical tie connection member, a motor operatively mounted and supported by the mechanical tie connection member, the motor in operative arrangement with a vertical output shaft configured to pass through at least one opening in the mechanical tie connection member, an output end of the vertical output motor shaft attached to the elongated switch blade at a midpoint of a longitudinal length of the elongated switch blade, a first break jaw attached to and in operative arrangement with the first of the elongated strain insulators at the first end thereof, a second break jaw attached to and in operative arrangement with the second of the elongated strain insulators at the first end thereof, the first break jaw including a first terminal in operative electrical circuit arrangement with the first cut end of the electric power line conductor, the second break jaw including a second terminal in operative electrical circuit arrangement with the second cut end of the electric power line conductor or with a jumper conductor, the first break jaw configured to make electrical and physical contact with one end of the elongated switch blade upon closing of the elongated switch blade, the second break jaw configured to make electrical and physical contact with an other end of the elongated switch blade upon closing of the elongated switch blade, the motor configured to horizontally rotate the elongated horizontally rotating elongated switch blade upon actuation of the motor into operative electric closed circuit arrangement simultaneously with the first break jaw contact and the second break jaw contact in the closed conductive switch position and the motor configured to horizontally rotate the elongated rotating switch blade via the vertical motor output shaft upon actuation of the motor out of operative electric closed circuit arrangement with the first break jaw contact and the second break jaw contact into the open non-conductive switch position, a communication system including a plurality of communication devices configured to actuate the motor as desired to horizontally rotate the elongated rotating switch blade via the vertical motor output shaft into operative electric closed circuit arrangement with the first break jaw contact and the second break jaw contact in the closed conductive switch position and to horizontally rotate the elongated rotating switch blade via the vertical motor output shaft out of operative electric closed circuit arrangement with the first break jaw contact and the second break jaw contact into the open non-conductive switch position, and, an energy supply configured to power the motor and the communication system.

2. The conductor suspended high voltage in-line double break disconnect switch of claim 1, wherein the mechanical tie connection member comprises an upper insulator tie plate and a lower insulator tie plate, wherein the pair of ganged elongated strain insulators having the second end of each of the pair of ganged elongated strain insulators operatively retained between the upper insulator tie plate and the lower insulator tie plate.

3. The conductor suspended high voltage in-line double break disconnect switch of claim 2, wherein the upper insulator tie plate having a first opening and the second insulator tie plate having a second opening operatively aligned with the first opening of the upper insulator tie plate, the vertical motor output shaft configured to pass through the first opening and the second opening.

4. The conductor suspended high voltage in-line double break disconnect switch of claim 1, wherein the switch blade comprises a top blade and an oppositely disposed bottom blade in parallel spaced relationship with the top blade.

5. The conductor suspended high voltage in-line double break disconnect switch of claim 4, wherein the vertical motor output shaft is operatively attached to the top blade midway between the one end and the other end of the switch blade.

6. The conductor suspended high voltage in-line double break disconnect switch of claim 1, wherein the plurality of communication devices includes three switch mounted short range radios configured to operate three switches of a three phase circuit in unison or separately.

7. The conductor suspended high voltage in-line double break disconnect switch of claim 6, further including a long range radio operatively mounted on one of the three switches configured to communicate with a utility control room long range radio to command an open or close operation of the switches.

8. The conductor suspended high voltage in-line double break disconnect switch of claim 7, wherein a ground level enclosure includes a ground level long range radio configured to communicate with the utility control room long range radio and to communicate with the switch mounted long range radio to command the open or close operation of the switches for operating a three phase switch arrangement.

9. The conductor suspended high voltage in-line double break disconnect switch of claim 8, wherein at least one solar panel is mounted at ground level and configured to power a ground level battery and the ground level long range radio.

10. The conductor suspended high voltage in-line double break disconnect switch of claim 6, wherein the communication system further includes a remote terminal unit configured to translate a radio signal to operate an electric control circuit to actuate a motor motion.

11. The conductor suspended high voltage in-line double break disconnect switch of claim 6, wherein the plurality of communication devices includes a portable wireless handheld control box including a control box mounted radio configured to communicate with each of the three switch mounted short range radios to operate each of the three of the high voltage in-line double break disconnect switches of the three phase circuit to open or close each of the high voltage in-line double break disconnect switches as desired.

12. The conductor suspended high voltage in-line double break disconnect switch of claim 1, wherein the energy supply comprises at least one solar charged battery connected in operative arrangement with the motor and the communication system.

13. The conductor suspended high voltage in-line double break disconnect switch of claim 12, wherein the energy supply further comprises at least one solar panel connected in operative arrangement with the at least one solar charged battery, the motor and the communication system.

14. The conductor suspended high voltage in-line double break disconnect switch of claim 13, further comprising a current transformer configured to charge a battery in operative arrangement with the at least one solar charged battery.

15. The conductor suspended high voltage in-line double break disconnect switch of claim 1, wherein the motor includes a first shaft configured to be coupled to a worm drive.

16. The conductor suspended high voltage in-line double break disconnect switch of claim 15, wherein the worm drive includes a worm screw carried on the motor first shaft and a worm gear carried on the vertical motor output shaft in operative relationship with the worm screw to open and close the switch blade.

17. The conductor suspended high voltage in-line double break disconnect switch of claim 16, wherein a manual operating eye ring is operatively attached to the worm screw.

18. The conductor suspended high voltage in-line double break disconnect switch of claim 16, further including a motor housing adapted to fit over the motor and operatively attached to the mechanical tie connection member.

19. The conductor suspended high voltage in-line double break disconnect switch of claim 18, further including at least one solar panel operatively attached to the motor housing.

20. The conductor suspended high voltage in-line double break disconnect switch of claim 1, further including an arc extinguishing device including a vacuum interrupter operatively attached to the switch and configured to be actuated by the horizontally rotating switch blade.

21. A switching arrangement for a high voltage electric utility three phase system, including three high voltage in-line communication system controlled motorized double break disconnect switches per phase of claim 1, each of the three switches at one end thereof operatively supported and suspended by and mounted in-line with one end of three electric power line conductors, and the other end of each of the three switches suspended by a third elongated strain insulator connected to a pole or other structure, each of the conductor suspended high voltage in-line motorized double break disconnect switches operatively mounted in one of the three phases configured to form a three phase three way switch array, a jumper conductor configured to electrically connect the three switches together so that opening or closing any one switch allows power to be sent in three different directions from multiple sources operatively mounted between the other end of each of the conductor suspended high voltage motorized in-line double break disconnect switches.

22. The switching arrangement for the high voltage electric utility three phase system of claim 21, wherein there is a two switch array instead of the three switch array configured to allow power to be sent in two directions from one source.

23. The switching arrangement for the high voltage electric utility three phase system of claim 22, wherein the jumper conductor is configured to electrically connect the two switches together to the one source instead of three switches so that opening or closing any one switch allows power to be sent in two different directions from the one source.

24. The switching arrangement for the high voltage electric utility three phase system of claim 22, wherein each of the double break switches further include an arc extinguishing device including a vacuum interrupter operatively attached to the switch and configured to be actuated by the elongated rotating switch blade.

25. The switching arrangement for the high voltage electric utility three phase system of claim 22, further including at least one solar panel operatively attached to a motor housing.

26. The switching arrangement for the high voltage electric utility three phase system of claim 21, wherein each of the double break switches further include an arc extinguishing device including a vacuum interrupter operatively attached to the switch and configured to be actuated by the elongated rotating switch blade.

27. The switching arrangement for the high voltage electric utility three phase system of claim 21, further including at least one solar panel operatively attached to a motor housing.

28. A three way or two way switching arrangement for a high voltage electric utility three phase system comprising three phases, each of the phases including respectively the three way or two way switching arrangement including respectively three or two radio controlled motorized in-line double break disconnect switches as claimed in claim 1, each of the switches including an elongated horizontally rotating switch blade and a motor for actuation of the switch blade operatively controlled by a short range radio, each of the switching arrangements including a first long range radio mounted to one of the switches in operative communication with a utility control room radio, each of the radio controlled motorized in-line double break disconnect switches including a ganged pair of coaxially aligned elongated strain insulators in supportive relationship with the elongated horizontally rotating switch blade, the motor in operative relationship with the elongated horizontally rotating switch blade, the three way or two way switching arrangements are mounted in switch arrays to a utility pole or structure in a phase over phase relationship.

29. The three way or two way switching arrangement for the high voltage electric utility three phase system of claim 28, wherein each of the in-line double break disconnect switches further includes an arc extinguishing device including a vacuum interrupter operatively attached to the switch.

30. The three way or two way switching arrangement for the high voltage electric utility three phase system of claim 28, further including at least one solar panel operatively attached to a motor housing.

31. The three way or two way switching arrangement for the high voltage electric utility three phase system of claim 28, further including a third strain insulator per respective in-line double break disconnect switch, the third strain insulator for each respective in-line disconnect switch is affixed at one end to the utility pole or structure and at the other end to the second strain insulator for the respective in-line double break disconnect switch, wherein the other end of the third strain insulator is configured to replace one of the two cut ends of the electric power line conductor for supporting and suspending the respective in-line double break disconnect switch and the two way or three way switches are electrically connected by jumper conductors so that power can be routed in two or three directions.

32. The three way or two way switching arrangement for the high voltage electric utility three phase system of claim 31, further including conductors operatively attached between switch terminals of each of the respective switches for carrying electric power line current.

* * * * *